US006077052A

United States Patent [19]

Gunn et al.

[11] Patent Number: 6,077,052

[45] Date of Patent: Jun. 20, 2000

[54] FLUID COMPRESSOR AFTERCOOLER TEMPERATURE CONTROL SYSTEM AND METHOD

[75] Inventors: John T. Gunn, Charlotte; Devin D. Biehler, Mocksville, both of N.C.

[73] Assignee: Ingersoll-Rand Company, Woodcliff Lake, N.J.

[21] Appl. No.: 09/146,229

[22] Filed: Sep. 2, 1998

[51] Int. Cl.[7] ..... F04B 49/00

[52] U.S. Cl. ..... 417/297; 417/297; 417/53

[58] Field of Search ..... 417/297, 243, 417/313, 53

[56] References Cited

U.S. PATENT DOCUMENTS

| | | | |
|---|---|---|---|
| 2,017,408 | 10/1935 | Hasche . | |
| 4,112,968 | 9/1978 | Hoffman et al. . | |
| 4,602,680 | 7/1986 | Bradford . | |
| 4,779,640 | 10/1988 | Cummings et al. . | |
| 4,838,343 | 6/1989 | Bogue . | |
| 5,145,000 | 9/1992 | Kluppel . | |
| 5,224,836 | 7/1993 | Gunn et al. | 417/14 |
| 5,240,386 | 8/1993 | Amin et al. . | |
| 5,287,916 | 2/1994 | Miller . | |
| 5,820,352 | 10/1998 | Gunn et al. | 417/53 |
| 5,967,757 | 10/1999 | Gunn et al. | 417/34 |

*Primary Examiner*—Philip H. Leung
*Assistant Examiner*—Vinod D Patel
*Attorney, Agent, or Firm*—Michael M. Gnibus

[57] ABSTRACT

A system and method for controlling the temperature of the compressed fluid flowing through a compressor aftercooler. The system includes a compression module flow connected to an aftercooler and at least one repositionable fluid flow regulating member upstream from the aftercooler for modifying the volume of ambient fluid supplied across the aftercooler. The system further includes a temperature sensor for sensing the ambient temperature, and an actuator connected to the at least one fluid flow regulating member. A controller is in signal receiving relation with the temperature sensor and is in signal transmitting relation with the actuator. If the sensed ambient temperature is outside a predetermined range, a repositioning signal is sent by the controller to the actuator, extending or retracting the actuator the amount required to achieve the required fluid flow rate across the aftercooler and thereby maintain the desired aftercooler fluid discharge temperature for the ambient operating temperatures.

17 Claims, 8 Drawing Sheets

FLUID COMPRESSOR AFTERCOOLER TEMPERATURE CONTROL SYSTEM AND METHOD

BACKGROUND OF THE INVENTION

The invention relates to a control system and method for maintaining the desired compressed fluid discharge temperature in a fluid compressor aftercooler, and more particularly the invention relates to a control system for maintaining a constant aftercooler compressed fluid discharge temperature by changing the position and orientation of at least one fluid flow regulating member based on the measured ambient temperature.

Conventional fluid compressors include a compression module which is comprised of an airend driven by a prime mover. Such airends are well known to those skilled in the art and usually include interengaging male and female rotors that rotate about parallel axes. A fluid, such as air, is supplied to the airend through the airend inlet, is compressed by the rotors, and is discharged out the airend discharge port or outlet. The compressed discharged fluid is hot and must be cooled before it may be supplied to an object of interest such as a pneumatic tool. In conventional fluid compressors the hot compressed fluid is flowed through an aftercooler that is flow connected to the airend discharge port. The aftercooler serves to cool the hot compressed fluid so that the compressed fluid supplied to the object of interest is at a desirable temperature.

A prior art aftercooler system is shown in FIG. 1 and is identified generally at 10. The aftercooler unit 11, has an inlet 12 through which hot, compressed fluid is supplied to the aftercooler from the airend (not shown) and a discharge port 13 through which the cooled, compressed fluid is flowed out of the aftercooler to an object of interest. Ambient cooling air is drawn across the aftercooler in the direction of arrows 18 by fan 17. The speed of the fan is controlled by electric fan motor 16. Temperature sensor 14 senses the temperature of the fluid discharged from aftercooler 11. The sensor is electrically connected in signal transmitting relation with microprocessor based controller 15. The system controller uses a Proportional-Integral-Derivative (PID) temperature control method well known to those skilled in the relevant art to determine the fan speed required to draw the sufficient volume of fluid through the aftercooler and cool the hot compressed fluid to the predetermined desired temperature. The controller 15 is electrically connected in signal transmitting relation to the fan motor 16.

In operation, the temperature sensor 14 senses the temperature of the fluid discharged from the aftercooler 11, and sends a signal representing the sensed discharge fluid temperature to the controller 15. If the sensed discharge fluid temperature is outside the desired range, the controller initiates the PID control logic and thereby determines the fan speed required to obtain the desired aftercooler discharge temperature. The controller sends a signal to the fan motor 16 altering the fan speed as required.

Although the prior art aftercooler control systems are generally effective at achieving the desired aftercooler discharge temperature there are a number of shortcomings associated with such prior art systems. First, because the PID control method relies on a derived algorithm to obtain the best performance, the derived must fit the compressed air system being monitored. Frequently, the algorithm proves difficult to derive accurately and does not include the correct constant values. If the algorithm is not tuned or derived to the required accuracy, the PID system will produce less than optimum results. Second, prior art aftercooler temperature control systems use only aftercooler outlet temperature to determine if the fan speed needs to be altered and only using the discharge temperature as the measurement can produce instabilities in the PID control loop performance. Finally, prior art systems frequently are analog systems that use electric or pneumatic controllers and such pneumatic based controllers are prone to freezing in cold weather, and electric systems can experience "hunting" or oscillating problems which produce unstable compressor operation.

The foregoing illustrates limitations known to exist in present aftercooler temperature control systems and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid compressor adapted for use in an ambient temperature, the fluid compressor including a compression module having an inlet for supplying an ambient fluid to the compression module and an outlet for flowing compressed fluid out of the compression module; a compressed fluid aftercooler flow connected to the compression module outlet; a temperature sensor for measuring the ambient temperature; at least one ambient fluid flow regulating member upstream from the aftercooler, the at least one ambient fluid flow regulating member adapted to be repositioned to modify the volume of ambient fluid supplied to the aftercooler; means for repositioning the at least one flow regulating member, the means for repositioning the at least one flow regulating member being connected to the at least one ambient fluid flow regulating member; and a controller in signal receiving relation with the temperature sensor means and in signal transmitting relation with the means for repositioning the at least one flow regulating member, the controller is adapted to send a repositioning signal to repositioning means to reposition the at least one fluid flow regulating member if the sensed ambient temperature is within a predetermined ambient temperature range.

The foregoing and other aspects will become apparent from the following detailed description of the invention when considered in conjunction with the accompanying drawing figures.

DESCRIPTION OF THE DRAWING FIGURES

Figure 6A:
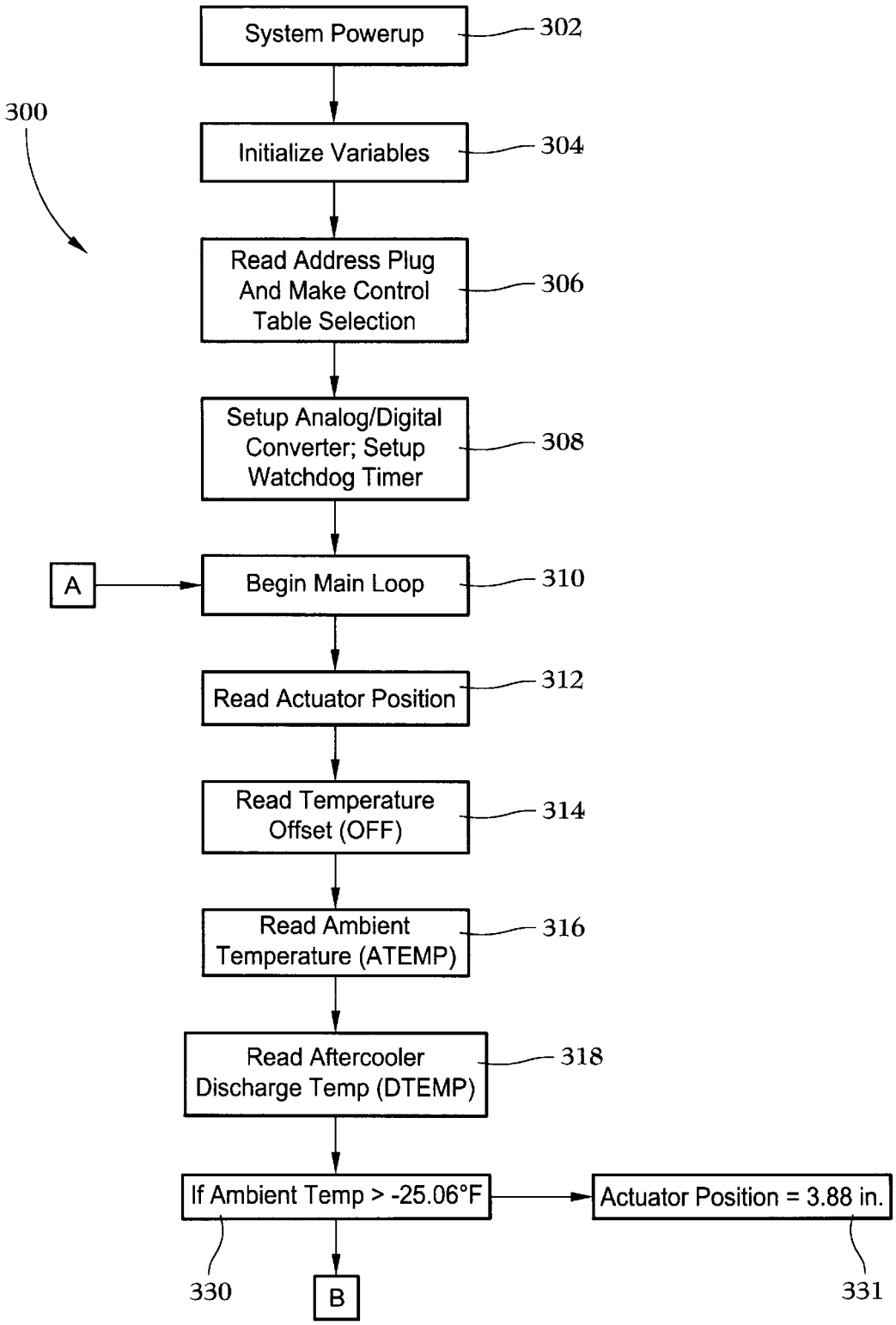
Figure 6B:
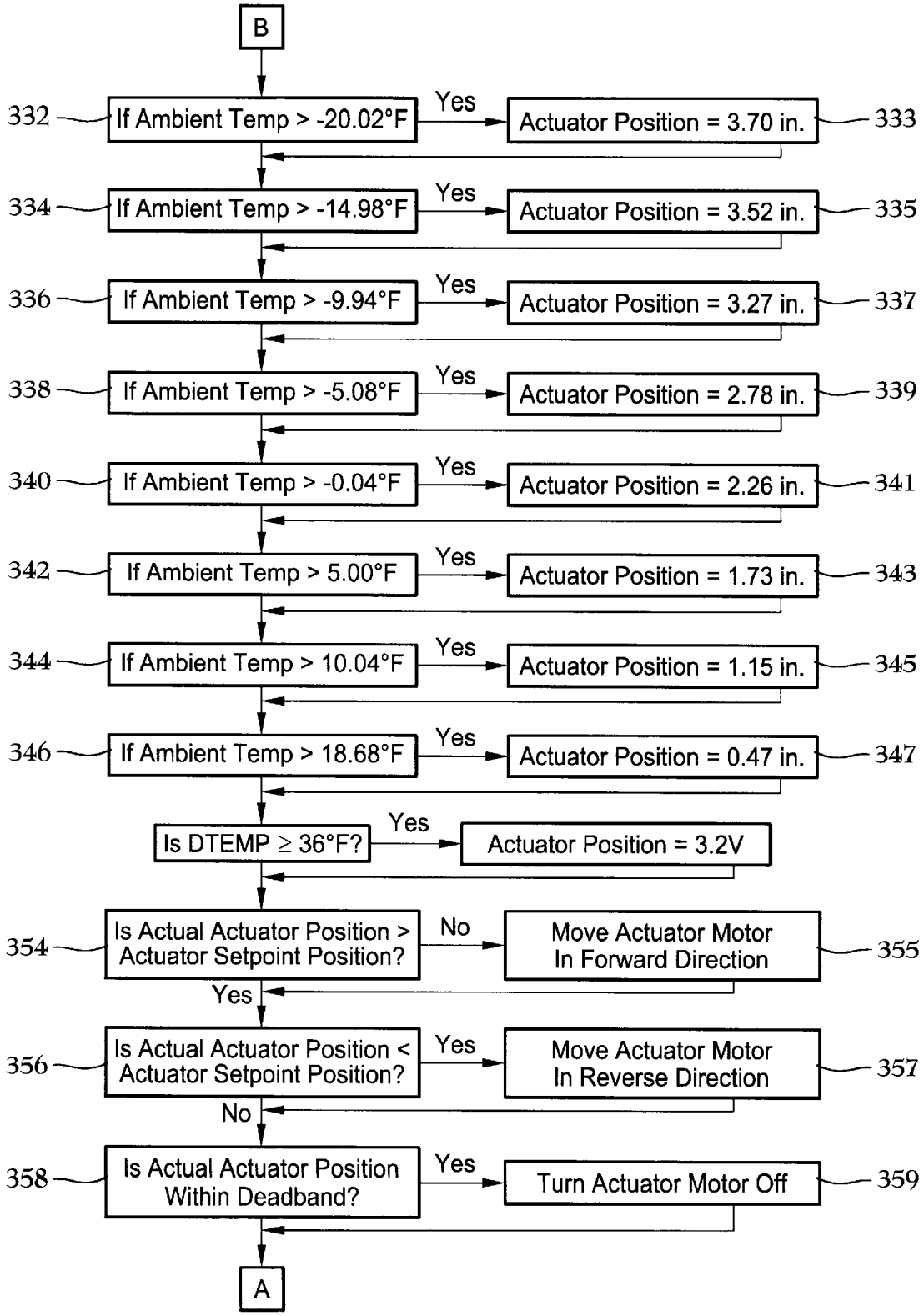
Figure 7:
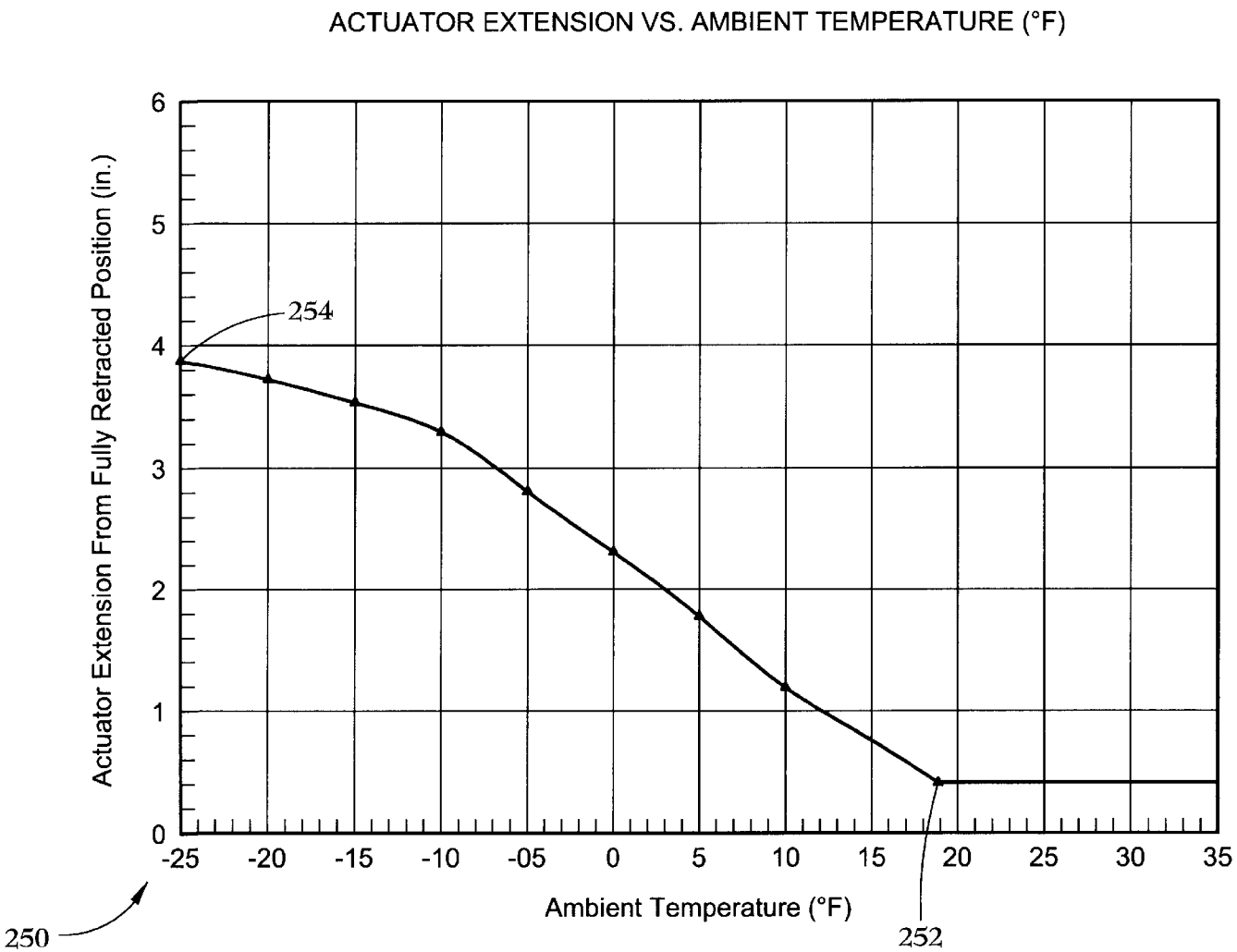

FIG. 6*a* is a flow diagram generally illustrating a first portion of the logic routine that controls the operation of the present invention aftercooler temperature control system;

FIG. 6*b* is a flow diagram generally illustrating a second portion of the logic routine that controls the operation of the present invention aftercooler temperature control system, FIGS. 6*a* and 6*b* together generally illustrate the logic routine of the present invention aftercooler temperature control system; and FIG. 7 is a plot of Actuator Extension in inches versus Ambient Temperature in ° F.

DESCRIPTION OF THE PREFERRED EMBODIMENT

Turning now to the drawings wherein like parts are referred to by the same number throughout the several views, FIGS. 2–6*b* show the aftercooler temperature control system of the present invention.

Figure 1:
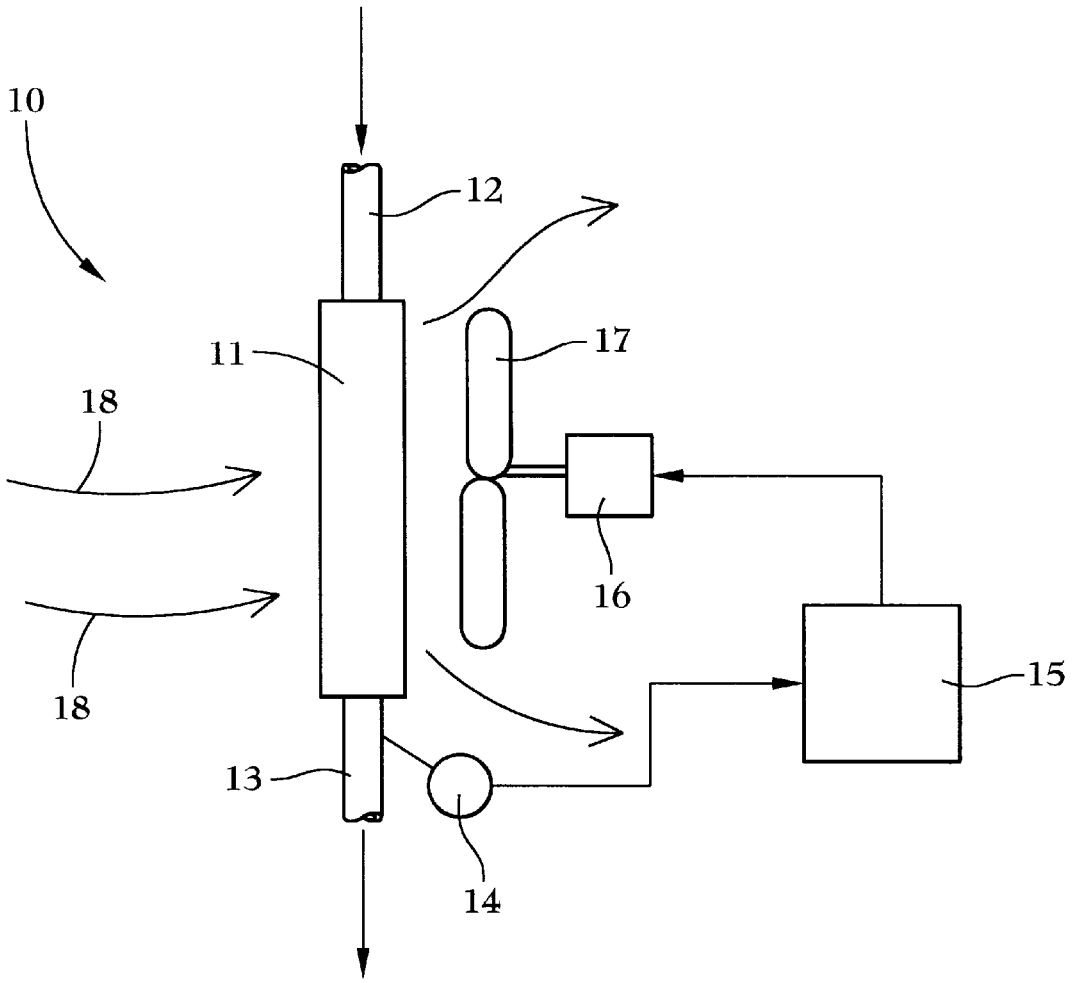
Fig. 1 (Prior Art)
FIG. 1 is a schematic representation of a prior art system for controlling the temperature of the compressed fluid in the aftercooler.
Figure 2:
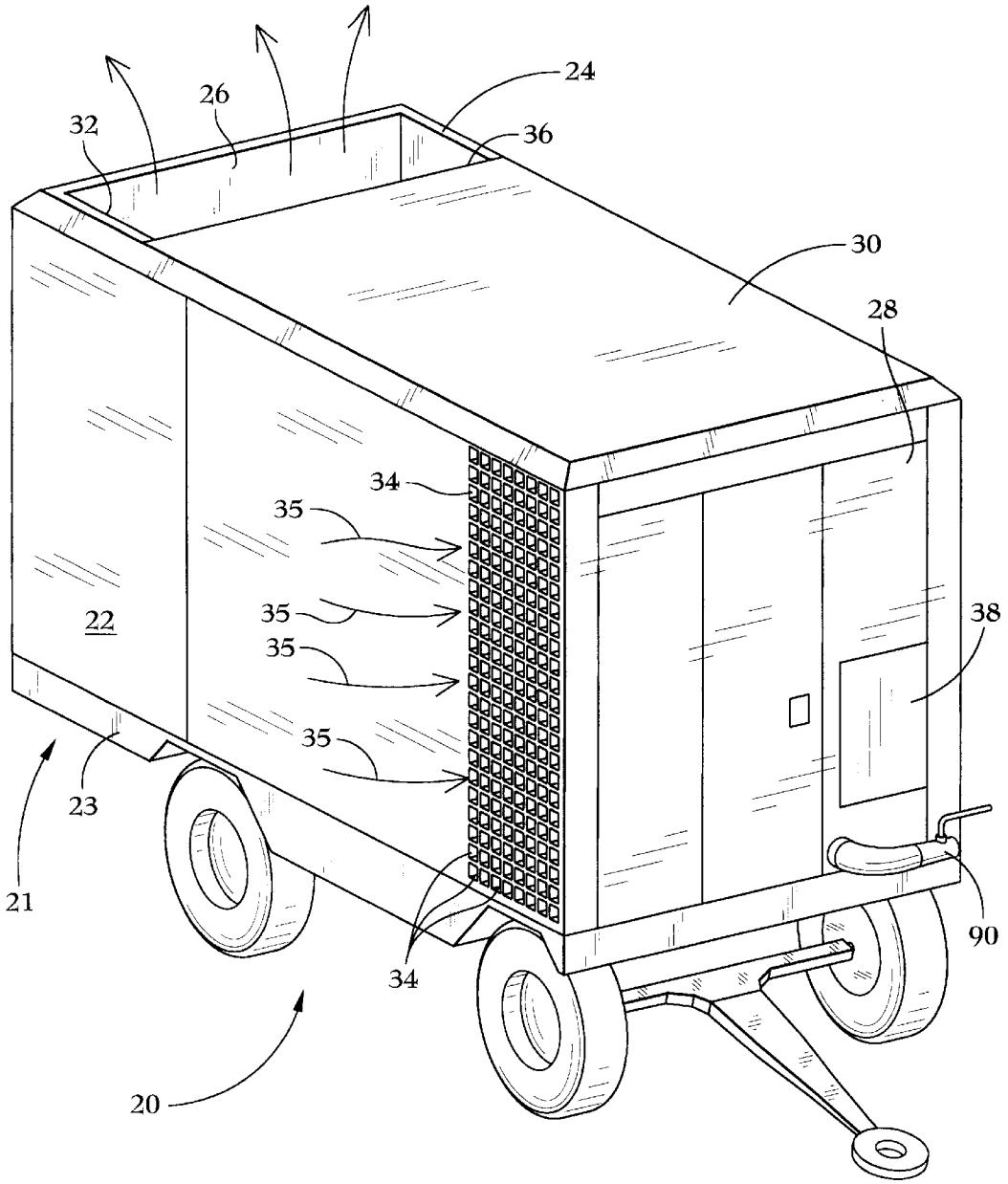
FIG. 2 is an isometric view of the portable compressor package that includes the aftercooler temperature control system of the present invention.

FIG. 2 generally illustrates portable fluid compressor 20 which includes the aftercooler temperature control system of the present invention. The compressor includes an enclosure 21 having longitudinal walls 22, 24; and lateral walls 26, 28, and top 30 which join the longitudinal walls. Together the walls 22, 24, 26, 28, and 30 define compressor interior 32. Enclosure 21 is supported along the bottom by frame 23. Both longitudinal walls include inlet apertures 34 through which ambient air enters the interior 32 in the direction of arrows 35. A portion of the ambient air is compressed by compression module 60 and the remainder of the ambient air is flowed across the aftercooler in the manner defined below. Uncompressed cooling ambient air is discharged out the opening 36 provided in top 30. Front lateral wall 28 includes operator control panel 38 that is shown generally in FIG. 2.

Figure 4:
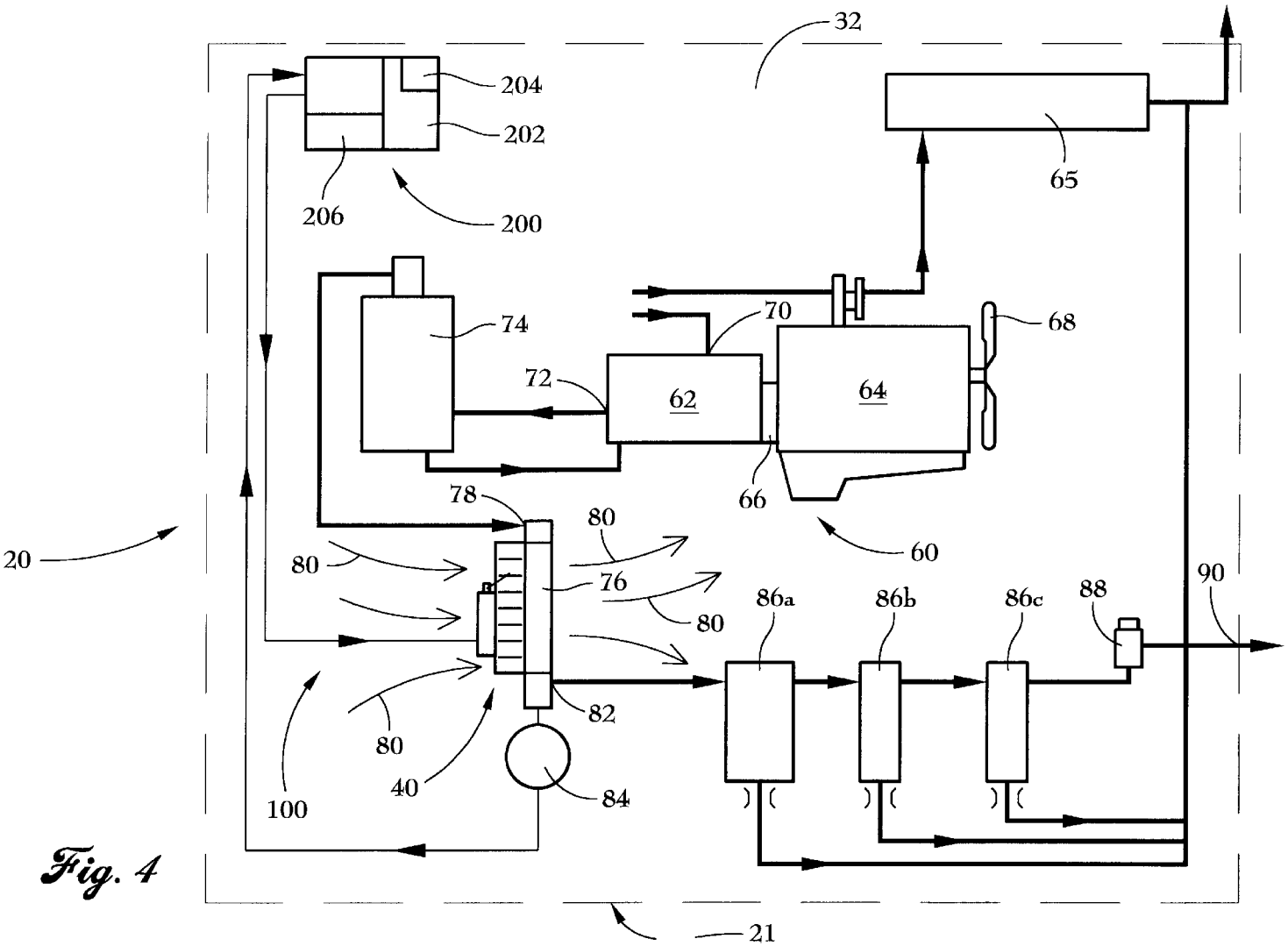
FIG. 4 is a schematic representation of the fluid compressor of FIG. 2.

FIG. 4 schematically shows the components of compressor 20 located in interior 32. As shown in FIG. 4, compression module 60 is comprised of airend 62 driven by prime mover 64 through a conventional coupling 66. The prime mover 64 which may be a diesel engine, includes engine exhaust manifold 65 and fan 68 which draws ambient air through the inlet apertures 34 and into interior 32. The airend is a conventional twin interengaging rotor design well known to one skilled in the art and includes ambient fluid inlet 70 and compressed fluid outlet 72.

The airend 62 is flow connected to conventional separator tank 74 that separates liquids such as oil and water, that mix with the ambient fluid during compression. The separator tank 74 is in turn flow connected to aftercooler 76. The aftercooler has an inlet 78 which receives a hot mixture comprised of compressed fluid, oil and water; and an aftercooler outlet 82 whereby the cooled mixture is discharged from the aftercooler.

The oil and water and any other liquid or solid effluent is separated from the compressed ambient fluid by first, second, and third coalescing filters 86*a*, 86*b*, and 86*c*, located downstream from the aftercooler. The cool, substantially effluent-free compressed service fluid is supplied through a minimum pressure valve 88 and out compressor discharge 90 to an object of interest.

The compression module 60, separator tank 74, temperature sensor 84 and coalescing filters 86*a,b*, and *c* are all of conventional design well known to one skilled in the art and therefore, further description of these compressor components is not required.

Now turning to the aftercooler temperature control system 100 of the present invention, the system 100 is generally comprised of microprocessor-based controller 200 and a fluid flow regulating assembly 40. The system 100 regulates fluid flow in response to the sensed ambient temperature readings.

The aftercooler 76 serves as a heat exchanger to cool the hot compressed fluid/effluent mixture by flowing ambient air through the aftercooler in the direction shown by arrows 80. The cooled mixture is discharged from the aftercooler through aftercooler discharge 82. The ambient air is supplied to the aftercooler by fluid flow regulating assembly 40 that is located upstream of the aftercooler in the direction of fluid flow 80. The temperature of the aftercooler discharge is measured by temperature sensor 84 which is a thermistor located in the aftercooler discharge 82.

Figure 3:
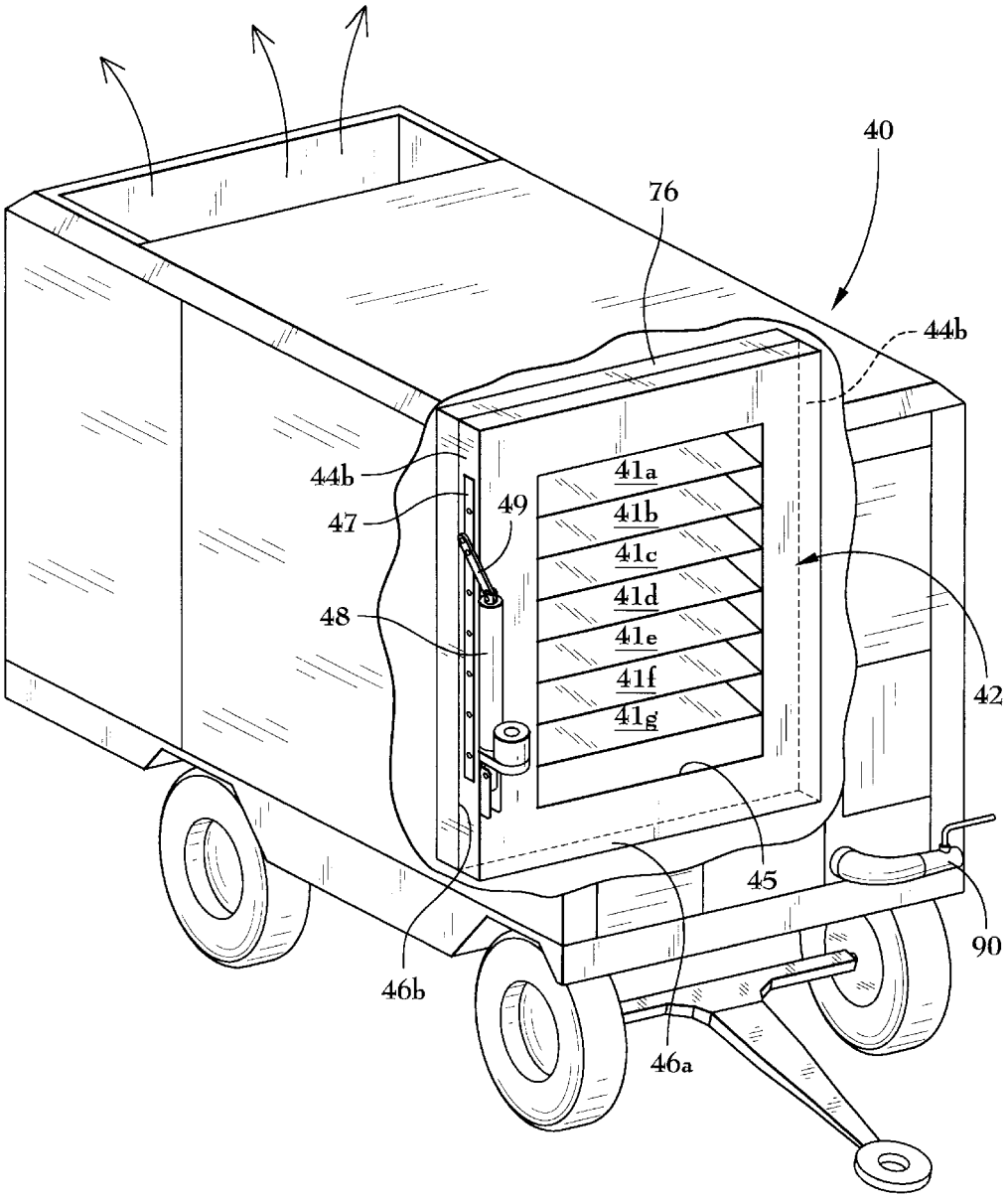
FIG. 3 is the isometric view of FIG. 2, with the front portion of the compressor enclosure partially broken away to show the fluid flow regulating assembly of the present invention aftercooler temperature control system.

FIG. 3 shows the general location and orientation of the fluid flow regulating assembly 40 within enclosure interior 32. As shown in FIG. 3, the assembly 40 includes at least one fluid flow regulating member. However for purposes of describing the preferred embodiment of the invention, seven discrete fluid flow regulating members 41*a*, 41*b*, 41*c*, 41*d*, 41*e*, 41*f*, and 41*g*are disclosed. The members are partially enclosed by assembly housing 42. The aftercooler 76 and housing are located back-to-back within the compressor interior 32. Flow openings 45 are provided in the housing inlet and discharge sides 46*a,b* joining sides 44*a, b*. The inlet opening is shown in FIG. 3.

The housing 42 serves as a barrier or wall dividing the interior 32 into front and rear sections. The housing extends between the top wall 30 and frame 23, and longitudinal walls 22 and 24 so that any ambient air drawn into the front of interior 32 through apertures 34 must pass through openings 45 in order to proceed through the aftercooler to the rear portion of the interior.

Figure 5:
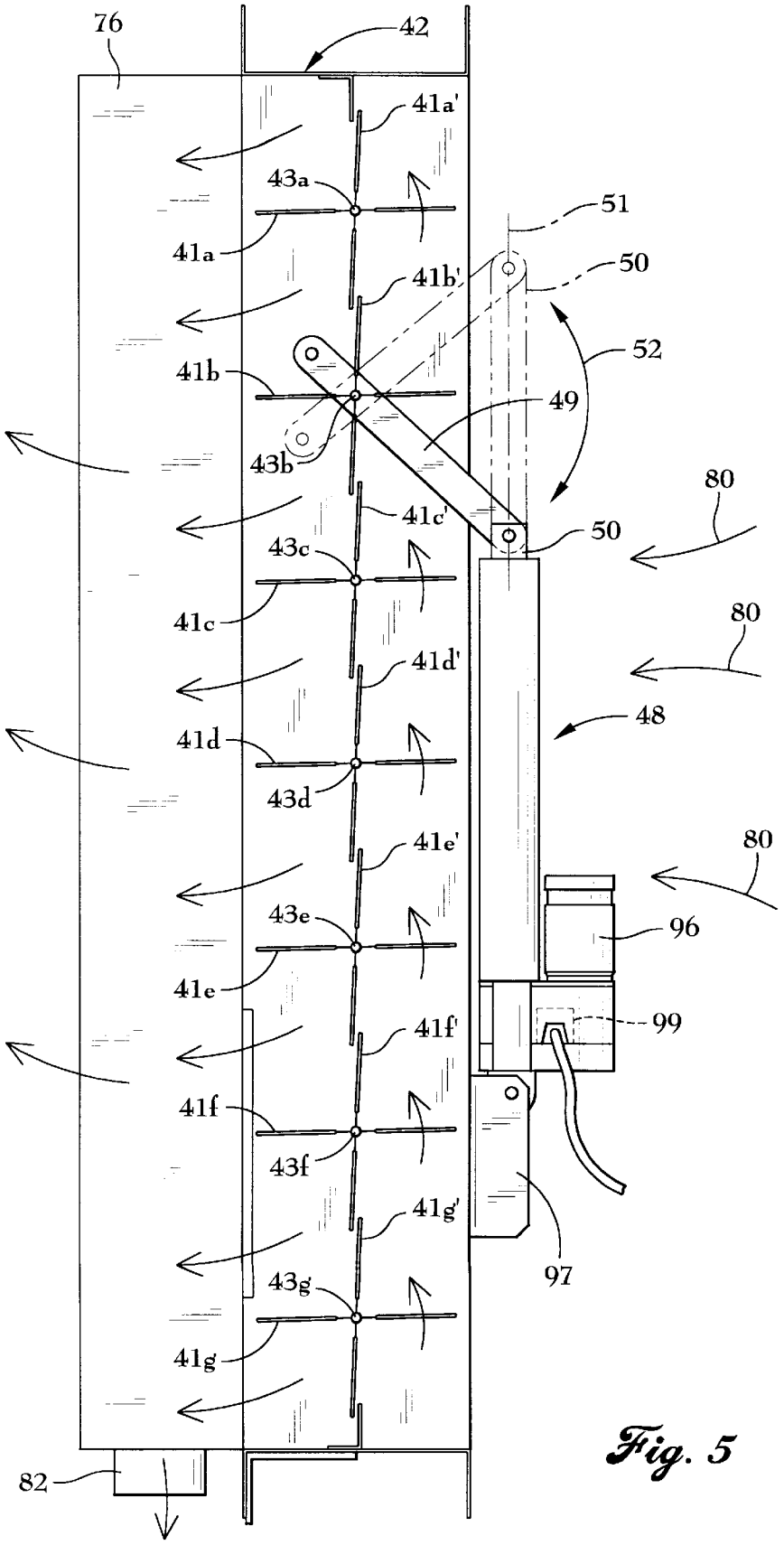
FIG. 5 is a longitudinal section view of the fluid flow regulating members and illustrates the connection between the members and the member repositioning means, and shows the first and second positions of the repositioning means and fluid flow regulating members.

Rods 43*a*–*g* the ends of which are shown in FIG. 5, extend longitudinally through each respective member 41*a*–41*g* and are supported at the rod ends by lateral housing sides 44*a* and 44*b*. Each rod defines a respective member axis of movement and members 41*a*–*g* are movable about the rods. The members are movable between a maximum flow orientation where the members are separated by a distance and are substantially horizontal; and a minimum flow position where the fluid flow regulating members are positioned end to end and are each oriented substantially vertical. The maximum and minimum flow orientations are illustrated in FIG. 5. In FIG. 5, the members in the minimum flow positions are identified by reference numbers 41*a*', 41*b*', 41*c*', 41*d*', 41*e*', 41*f*', and 41*g*' and the members in the maximum flow orientations are identified by reference numbers 41*a*–41*g*.

As shown in FIG. 3, one end of the members is attached to connection link 47 which in turn is attached to linear actuator 48 by driven link 49. The linear actuator is conventionally mounted on the inlet housing face 46*a* by bracket 97. One end of the driven link 49 is rotatably connected to movable actuator stem 50 and the opposite end of the link 49 is rotatably connected to link 47 by a pin or other conventional connection. The stem is extended and retracted along axis 51 by the repositioning means 48 which for purposes of the preferred embodiment is an electrically actuated linear actuator that conventionally extends and retracts the stem in response to electrically signals sent to the linear actuator by controller 200. However, it should be understood that any repositioning means that responds to electrical signals may be used to move the members.

When the stem 50 and attached end of link 49 are moved in the required direction by motor 96, the driven member 49 rotates about the connection point between links 47 and 49 either clockwise or counterclockwise as indicated by arrow 52, and by this rotation, moves the members 41*a–g* in unison, to the required position. Moving the members in unison is achieved in a conventional manner well known to one skilled in the art. The stem retracted and extended positions are shown in FIG. 5 in solid and dashed fonts respectively. When the stem is in the retracted position, the flow regulating members 41*a–g* are substantially horizontal, maximum flow orientation, and when the stem is extended, the members are in the minimum flow position and are substantially vertical. The stem may be repositioned between the extended and retracted positions to achieve the desired fluid flow across the aftercooler to maintain the desired discharge fluid temperature. It is anticipated that in another embodiment, the members 41*a*–41*g* could be in the minimum flow position when the stem is retracted, and could be in the maximum flow orientation when the stem is extended.

A conventional position feedback potentiometer 99 is made integral in actuator 48 and the potentiometer determines the position of the movable stem. The potentiometer is electrically connected to the controller 200 in signal transmitting relation and transmits an electrical signal representing the stem position to the controller processor 202.

Microprocessor based controller 200 electronically determines whether or not it is necessary to move the actuator stem during operation of compressor 20 in order to maintain the desired constant aftercooler discharge temperature. The controller includes an ambient temperature sensor 204 that is for purposes of the preferred embodiment embedded in the micro controller chip or processor 202. The controller monitors the ambient temperature input received from sensor 204 and the discharge temperature input received from sensor 84 and based on the ambient temperature input determines the required position of members 41*a–g*. The ambient temperature sensor could be a discrete sensor electrically connected to processor 202 but not embedded in the microprocessor.

Unlike conventional control system 10, controller 200 of system 100 is a digital controller utilizing fuzzy logic to determine the required actuator stem position for a given ambient temperature. By using a digital controller, the fluid flow to the aftercooler can be controlled more precisely than with conventional PID control methods. By accurately determining the required stem actuator position, and moving the stem to the position through system 100, the required orientation of the members 41*a–g* is obtained and constant aftercooler temperature is achieved.

For a given ambient temperature, the fluid flow required to maintain constant aftercooler discharge temperature for different capacity compressors is different for a given compressor. The relationship between flow regulating member orientation and ambient temperature is determined empirically and through well known fluid flow and heat transfer calculations. These experiments and calculations are conventional and do not form part of the claimed invention. FIG. 7 is a graph illustrating the relationship between the required actuator extension from a reference position such as the fully retracted position versus ambient temperature, for compressor 20. By quantifying the actuator position required to achieve the desired flow rate across members 41*a–g* for a given temperature, constant aftercooler discharge temperature may be achieved.

Referring to the graph 250 in FIG. 7, when the ambient temperature is equal to or exceeds a first minimum temperature limit point 252 equal to approximately 18.68° F.(−7.4° C.), the actuator is substantially fully retracted and the distance from the reference point which in this preferred embodiment is the fully retracted position, is equal to 0.47 in (1.19 cm), and when the ambient temperature is equal to or exceeds a second minimum temperature limit point 254 equal to approximately −25.06° F. (−31.7° C.), the stem is substantially fully extended which for the actuator disclosed in this preferred embodiment is equal to a distance equal to approximately 3.88 inches(9.86 cm).

It has been determined through experimentation and calculation that in order to achieve constant aftercooler discharge temperature for compressor 20, the stem should be extended from the retracted position the following distances for the corresponding ambient temperatures. Additionally, the potentiometer feedback voltage corresponding to the required actuator position is provided in the following TABLE in volts.

TABLE

| Temp ° F.(° C.) | Actuator Extension From Fully Retracted in Inches (com) | Feedback Signal (v) |
|---|---|---|
| 18.68(−7.4) | 0.47(1.19) | 0.10 |
| 10.04(−12.2) | 1.15(2.92) | 1.22 |
| 5.00(−15.0) | 1.73(4.39) | 1.74 |
| −0.04(−17.8) | 2.26(5.74) | 2.01 |
| −5.08(−20.6) | 2.78(7.00) | 2.20 |
| −9.94(−23.3) | 3.27(8.31) | 2.26 |
| −14.98(−26.1) | 3.52(8.94) | 2.35 |
| −20.02(−28.9) | 3.70(9.39) | 2.41 |
| −25.06(−31.7) | 3.88(9.86) | 2.48 |

The relationships between ambient temperature and actuator extension distance from the fully retracted position are unique for compressor 20 and would likely be different for another compressor. The above-listed empirical information is stored in memory 206 and is accessed by processor 202 during operation compressor 20 and control system 100.

Since ambient temperature, rather than conventional aftercooler discharge temperature, is used to regulate fluid flow through the aftercooler, the required aftercooler discharge temperature is obtained and maintained by the invention. For a given fluid flow regulating member position, the ambient temperature is an accurate predictor of the aftercooler discharge temperature. In the present system, the aftercooler discharge temperature is used as an override input to control the fluid flow regulating member position in the event the aftercooler discharge temperature is equal to or below 36° F. See Steps 320.

Temperature control unit logic routine 300 illustrated generally in FIGS. 6*a* and 6*b* is stored in memory 206 and is continuously and rapidly executed by controller processor 202 during operation of compressor 20.

Operation of system 100 will now be described. Logic Steps 304, 306, and 308 are only executed when the system controller 200 is turned on or powered up in Step 302. The singly executed Steps include initializing all logic routine variables, Step 304; reading address plug and making the control table selection (like TABLE) for the respective compressor, Step 306; and setting the analog/digital converter and timer, Step 308. In Step 306, the routine determines the type of compressor 20 operating and then retrieves the corresponding actuator position/ambient temperature information from memory 206. The retrieved information is analogous to the information shown in the TABLE. In Step 308, a timer and digital converter for use in other portions of routine 300 not part of the claimed invention, are setup and initialized for use.

Once begin main loop Step 310 is passed, the logic routine executes the main logic loop and does not repeat Steps 302–308.

In Step 312, the stem position is obtained from potentiometer 99 by controller processor 202. A feedback voltage representing the actual actuator stem position is sensed by the potentiometer and is transmitted to the processor. As illustrated in TABLE, each actuator position has a representative voltage stored in memory 206. During operation of the compressor, the processor compares the stored representative voltage corresponding to the required actuator position to the actual sensed feedback voltage reading to determine if the stem needs to be moved to be located at the required position.

In Step 314, the logic routine determines the temperature offset required to calibrate the sensor 204 in processor 202. The required offset is based on published empirical data for the microprocessor 202 used in the controller 200. The offset variable OFF, is assigned a value equal to the required microprocessor offset.

In Step 316 the processor 202 reads the ambient temperature sensed by sensor 204. The ambient temperature variable ATEMP is assigned the sensed value.

In Step 318, the controller reads the aftercooler discharge temperature obtained by sensor 84, and sets the discharge temperature variable DTEMP, equal to the sensed temperature value.

Steps 330, 332, 334, 336, 338, 340, 342, 344, and 346 access the actuator position/ambient temperature information (See TABLE) previously stored in memory 206. In Steps 330–346 the routine 300 determines the range where the ambient temperature ATEMP falls and matches a corresponding required actuator position. For Example, in Step 330, if the ambient temperature is less than 18.68° F.(−7.4° C.), the actuator setpoint position is 0.47 in(1.19 cm), and the actuator stem is located at an almost fully retracted position, and as a result, the members 41*a–g* are at maximum flow position and a maximum volume of ambient fluid is supplied across the aftercooler.

The ambient temperature of Step 330 represents a first minimum flow point, and the ambient temperature of Step 346 represents a second minimum flow point. In Step 346, when the ambient temperature is equal to or exceeds −25.06° F.(−31.7° C.), the actuator is fully extended to the setpoint position equal to 3.88 in.(9.86 cm) and the members 41*a*–41*g* are substantially vertical and are in a minimum flow position. In Step 330, when the ambient temperature is equal to or exceeds 18.68° F.(−7.40° C.), the actuator if fully retracted as described above. Steps 332–344 represent ambient temperature/actuator position relationships between the first and second minimum flow points 252 and 254.

If the ambient temperature falls within the ambient temperature range set forth in Steps 332–344 a signal is sent to the actuator repositioning the stem 50 to the actuator setpoint position corresponding to the actual ambient temperature. Once the routine determines the actual ambient temperature, a corresponding actuator setpoint position is assigned in the corresponding set point assignment Step 333, 335, 337, 339, 341, 343, 345, or 347 corresponding to Steps 332–356. See FIGS. 6*a* and 6*b*.

Steps 320 and 324 represent the ambient temperature override Steps. In Step 320 the controller determines if DTEMP is equal to or greater than 36° F. (2.22° C.). If the aftercooler discharge temperature is not equal to or greater than 36° F., the logic routine executes Step 324 and sets the actuator position to the substantially fully extended position equal to 3.88 inches in Step 324. The routine 300 returns to execute Step 354.

In Step 354, the actual actuator position obtained previously in Step 314 is compared with the setpoint actuator position obtained in one of the set point assignment steps. The system compares the actual potentiometer feedback voltage to the stored voltage to determine the actuator position during this Step. If the actual actuator position is greater than the set point actuator position, the routine executes step 355 and the controller sends a signal to the actuator motor 96 and causes the actuator motor to move in a first direction causing the stem to be retracted a distance equal to the difference between the actual and setpoint positions.

If the actual actuator position is less than the actuator setpoint position in Step 356, the routine executes step 357 and the controller sends a signal to the actuator motor which moves the actuator motor in a second direction causing the stem to be extended a distance equal to the difference between the setpoint and actual positions.

Once it is determined that the actual actuator position is within a deadband or tolerance range, relative to the actual position in Step 358, the controller sends a signal to the actuator motor shutting the motor off. In either instance, when the stem is moved in response to ambient temperature reading, the members are repositioned in unison to achieve the required fluid flow to the aftercooler.

The routine 300 then returns to Step 310 and repeats the main portion of the routine Steps 310–359.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What is claimed is:

1. A fluid compressor adapted for use in an ambient temperature, the fluid compressor comprising:

a) a compression module including an inlet for supplying an ambient fluid to the compression module and an outlet for flowing compressed fluid out of the compression module;

b) a compressed fluid aftercooler flow connected to the compression module outlet;

c) temperature sensor means for measuring the ambient temperature;

d) at least one ambient fluid flow regulating member upstream from the aftercooler, the at least one ambient fluid flow regulating member adapted to be repositioned to modify the volume of ambient fluid supplied to the aftercooler;

e) means for repositioning the at least one fluid flow regulating member, the means for repositioning the at least one flow regulating member being connected to the at least one ambient fluid flow regulating member; and f) a controller in signal receiving relation with the temperature sensor means and in signal transmitting relation with the means for repositioning the at least one flow regulating member, the controller is adapted to send a repositioning signal to repositioning means to reposition the at least one fluid flow regulating member if the sensed ambient temperature is within a predetermined ambient temperature range.

2. The fluid compressor as claimed in claim 1 wherein the at least one fluid flow regulating member is comprised of a plurality of louvers that move together in response to movement by the repositioning means.

3. The fluid compressor as claimed in claim 1 wherein the means for repositioning the at least one fluid flow regulator is a linear actuator.

4. The fluid compressor as claimed in claim 3 wherein the linear actuator includes an actuator member that is movable linearly in response to the signal sent by the controller.

5. The fluid compressor as claimed in claim 4 wherein the actuator member is moved to a first position when the ambient temperature is equal to or exceeds a first temperature limit, is moved to a second position when the ambient temperature is equal to or exceeds a second temperature limit, and when the ambient temperature is between first and second temperature limits the actuator member is moved to a predetermined position between the first and second positions corresponding to the ambient temperature.

6. The fluid compressor as claimed in claim 5 wherein the first actuator member is retracted when it is in the first position, and the actuator member is extended when it is in the second position.

7. The fluid compressor as claimed in claim 5 wherein the first predetermined temperature is a minimum high temperature, and the second predetermined temperature is a minimum low temperature, the at least one fluid flow regulating member being positioned to permit maximum flow to the aftercooler when the ambient temperature is equal to or greater than the first predetermined temperature, and the at least one fluid flow regulating member is positioned to achieve minimum flow to the aftercooler when the ambient temperature is equal to or less than the second predetermined temperature.

8. The fluid compressor as claimed in claim 6 wherein the fluid flow regulating members are comprised of a plurality of louvers, wherein the louvers are positioned to a minimum flow position when the actuator member is extended, and are positioned to a maximum flow position when the actuator member is retracted.

9. The fluid compressor as claimed in claim 1 wherein the controller is a microprocessor based electronic controller.

10. In a fluid compressor comprising a compression module for producing a compressed fluid; an aftercooler flow connected to the compression module, the after cooler for cooling the compressed fluid temperature; means for regulating the flow of ambient fluid to the aftercooler, the regulating means located upstream from the aftercooler; means for repositioning the fluid flow regulating means; and a controller electrically connected to the repositioning means in signal transmitting relation to the repositioning means, said controller comprising an ambient temperature sensor; a method for controlling the aftercooler discharge temperature, the method comprising the following steps:

a) sensing the ambient temperature;

b) determining if the sensed ambient temperature is within a first predetermined ambient temperature range;

c) determining the setpoint position of the repositioning means corresponding to the sensed ambient temperature;

d) sending a signal from the controller to the repositioning means to move the repositioning means to the required setpoint position for the sensed ambient temperature.

11. The method as claimed in claim 10, the compressor further including aftercooler discharge temperature sensor, the method comprising the additional steps of: determining the aftercooler discharge temperature; determining if the ambient temperature is within a second temperature range; if the ambient temperature is within a second temperature range, applying a temperature offset, and then continuing with step a).

12. The method as claimed in claim 11 wherein the second temperature range is equal to or greater than 36° F., and the offset is applied to the discharge temperature by subtracting the offset from the aftercooler discharge temperature.

13. The method as claimed in claim 12 comprising the additional step of setting the ambient temperature equal to the offset aftercooler discharge temperature.

14. The method as claimed in claim 11 wherein if the ambient temperature is greater than a first minimum temperature control point, the repositioning means is moved to a first position, and if the ambient temperature exceeds or is equal to a second minimum ambient temperature, the repositioning means is moved to a second position.

15. The method as claimed in claim 14 wherein at the first position the reposition means is extended and at the second position the repositioning means is retracted.

16. The method as claimed in claim 11 the method comprising the additional steps of determining the actual actuator position, comparing the actual actuator position to the setpoint actuator position and sending a signal from the controller to the repositioning means to move the actuator a distance substantially equal to the difference between the actual and setpoint actuator positions.

17. The method as claimed in claim 11 wherein the controller sends a signal to the repositioning means shutting off the repositioning means when the repositioning means is substantially at the required position.

* * * * *